US008957003B2

(12) United States Patent
Wu et al.

(10) Patent No.: US 8,957,003 B2
(45) Date of Patent: Feb. 17, 2015

(54) MODIFIED LUBRICANT

(71) Applicant: Enerage Inc., Yilan County (TW)

(72) Inventors: Mark Y. Wu, Yilan County (TW); Cheng-Yu Hsieh, Yilan County (TW); Jun-Meng Lin, Yilan County (TW); Chen-Xin Yu, Yilan County (TW)

(73) Assignee: Enerage Inc., Yilan County (TW)

( * ) Notice: Subject to any disclaimer, the term of this patent is extended or adjusted under 35 U.S.C. 154(b) by 0 days.

(21) Appl. No.: 13/895,845

(22) Filed: May 16, 2013

(65) Prior Publication Data

US 2014/0342955 A1 Nov. 20, 2014

(51) Int. Cl.
*C10M 103/02* (2006.01)
*C10M 125/02* (2006.01)
*C10M 171/06* (2006.01)

(52) U.S. Cl.
CPC ..... *C10M 125/02* (2013.01)
USPC ..... 508/113; 508/116; 508/122; 508/123; 508/131

(58) Field of Classification Search
CPC ..... C10M 103/02; C10M 125/02; C10M 171/06; C10M 2201/041
USPC ..... 508/113–131
See application file for complete search history.

(56) References Cited

U.S. PATENT DOCUMENTS 7,871,533 B1 * 1/2011 Haiping et al. ..... 252/70
8,075,799 B2 * 12/2011 Hong et al. ..... 252/70
8,192,643 B2 * 6/2012 Zheng et al. ..... 252/73
8,222,190 B2 7/2012 Zhamu et al.
8,227,386 B2 * 7/2012 Xiao et al. ..... 508/113
8,435,931 B2 * 5/2013 Habeeb et al. ..... 508/128
8,648,019 B2 * 2/2014 Pol et al. ..... 508/113
8,703,666 B2 * 4/2014 Tsou et al. ..... 508/131
2005/0271574 A1 12/2005 Jang et al.
2010/0204072 A1 * 8/2010 Kwon et al. ..... 508/113
2012/0032543 A1 * 2/2012 Chakraborty et al. ..... 310/90
2013/0079262 A1 * 3/2013 Pol et al. ..... 508/116
2013/0178402 A1 * 7/2013 Chauveau et al. ..... 508/131
2013/0324447 A1 * 12/2013 Tsou et al. ..... 508/131
2013/0341028 A1 * 12/2013 Christian et al. ..... 166/305.1
2014/0038862 A1 * 2/2014 Haque et al. ..... 508/128

* cited by examiner

*Primary Examiner* — Ellen McAvoy

(74) *Attorney, Agent, or Firm* — Muncy, Geissler, Olds & Lowe, P.C.

(57) ABSTRACT

A modified lubricant includes lubricant grease and nano-graphite plates dispersed thoroughly in the lubricant grease. The content of the nano-graphite plates is 0.0001 wt % to 10 wt %. Each nano-graphite plate has a length or a width between 1 and 100 μm, a thickness within 10 nm and 100 nm, and N graphene layers stacked together and a surface modifying layer disposed on the top or bottom of the nano-graphite plates, wherein N is 30 to 300. The surface modifying layer has a surface modifying agent which includes at least two functional groups located at two ends of the surface modifying agent, one of the two functional groups is chemically bonded with certain organic functional group remaining on the surface of the nano-graphite plate, and the other of the two functional groups forms the functional surface of the nano-graphite plate.

9 Claims, 6 Drawing Sheets

(b)

(a)

MODIFIED LUBRICANT

BACKGROUND OF THE INVENTION

1. Field of the Invention

The present invention generally relates to a lubricant and more specifically to a lubricant having advanced thermal conductivity due to the nano-graphite plates included therein.

2. The Prior Arts

In general, the monolayer graphite, also called graphene, has a lattice structure formed by a monolayer of carbon atoms, which are tightly packed in two-dimensional honeycomb crystal lattice by the graphite bond (sp2). Thus, the monolayer graphite has a thickness of one carbon atom. The graphite bond is a composite chemical bond derived from the covalent bond and the metallic bond, such that graphene is a perfect substance possessing both key properties of an insulator and a conductor. In 2004, Andre Geim and Konstantin Novoselov at the University of Manchester in the UK successfully proved that graphene is obtained from a piece of graphite by using adhesive tape, and were thus awarded the Nobel Prize in Physics for 2010. Graphene is the thinnest and hardest material in the world now. It has thermal conductivity greater than that of carbon nanotube and diamond. Its electron mobility at room temperature is higher than the carbon nanotube and silicon crystal. Also, the electric resistivity of graphene is even lower than that of copper or silver, and so far is considered as the material with the lowest resistivity.

In the prior arts, graphene can be produced by three methods, including graphite exfoliating, direct growth and carbon nanotube transformation. Especially, the graphite exfoliating method is used to form graphene powder. The most suitable method for mass production is the method of redox reaction. Specifically, the graphite material is first oxidized to form graphite oxide, and it is then processed by separation and reduction reaction to obtain graphene.

US Patent Publication No. 20050271574 disclosed a process for producing graphene, which includes the steps of first performing intercalation by strong acid on a piece of natural graphite, primarily exfoliating the piece of natural graphite by suddenly contacting with a high heat source, and then completely exfoliating the piece of natural graphite by using high energy grinding balls so as to form graphene powder. Whatever method is used to produce graphene powder, owing to the nanometer structure of graphene, the present process is not only complicated and is badly polluted, but the tap density of the manometer material is also much lower. For example, the tap density is much less than 0.01 g/cm$^3$, and the resultant volume is much larger such that it is possible to aggregate by Van der Waals' forces. Therefore, it is a challenge for mass production or industrial application even graphene possesses such excellent physical properties, and it is easy to cause negative effect on derivative products.

U.S. Pat. No. 8,222,190 disclosed a modified lubricant consisting of nano graphene. The embodiment disclosed that the friction coefficient of the lubricant having 5 wt % graphene is less than half to the friction coefficient of the lubricant having 5 wt % nano graphite powders or nano carbon tubes. However, the performance appears under the condition of the amount of the graphene greater than 5 wt % due to the aggregate of graphene.

SUMMARY OF THE INVENTION

The primary objective of the present invention is to provide a modified lubricant including lubricant grease and a plurality of nano-graphite plates dispersed in the lubricant grease thoroughly. The content of the nano-graphite plates is 0.0001 wt % to 10 wt % in the modified lubricant. Each nano-graphite plate has a length or width between 1 and 100 μm, and a thickness T within 10 nm and 100 nm. The nano-graphite plate includes N graphene layers stacked together and at least one surface modifying layer disposed on the top surface of the top graphene layer and/or the bottom surface of the bottom graphene layer, wherein N is 30 to 300 and the ratio (L/T) of the lateral dimension L to the thickness T is within 10 and 10,000.

The surface modifying layer includes at least one surface modifying agent, which is one of coupling agent, fatty acid and resin. The surface modifying agent includes at least two functional groups located at two ends of the surface modifying agent, respectively. One of the two functional groups is chemically bonded with certain organic functional group remaining on the surface of the nano-graphite plate, and the other of the two functional groups forms the functional surface of the nano-graphite plate. Thus, the surface characteristics of the nano-graphite plate is changed, so that the nano-graphite plate structure is easily and evenly dispersed in the lubricant grease.

Since the nano-graphite plate which has the properties between the natural graphite and graphene is added in the lubricant and the surface properties of the nano-graphite plates are modified, the aggregation effect due to Van der Waals' forces is not as serious as graphene and the nano-graphite plates can be dispersed thoroughly in the lubricant grease. Furthermore, the thermal conductivity of the lubricant is improved due to the properties of the nano-graphite plates which are similar to the graphene.

BRIEF DESCRIPTION OF THE DRAWINGS

The present invention can be understood in more detail by reading the subsequent detailed description in conjunction with the examples and references made to the accompanying drawings, wherein:

FIG. 3(*b*) is the SEM view of natural graphite;

DETAILED DESCRIPTION OF THE PREFERRED EMBODIMENTS

The present invention may be embodied in various forms and the details of the preferred embodiments of the present invention will be described in the subsequent content with reference to the accompanying drawings. The drawings (not to scale) show and depict only the preferred embodiments of the invention and shall not be considered as limitations to the scope of the present invention. Modifications of the shape of the present invention shall be considered to be within the spirit of the present invention.

Figure 1:
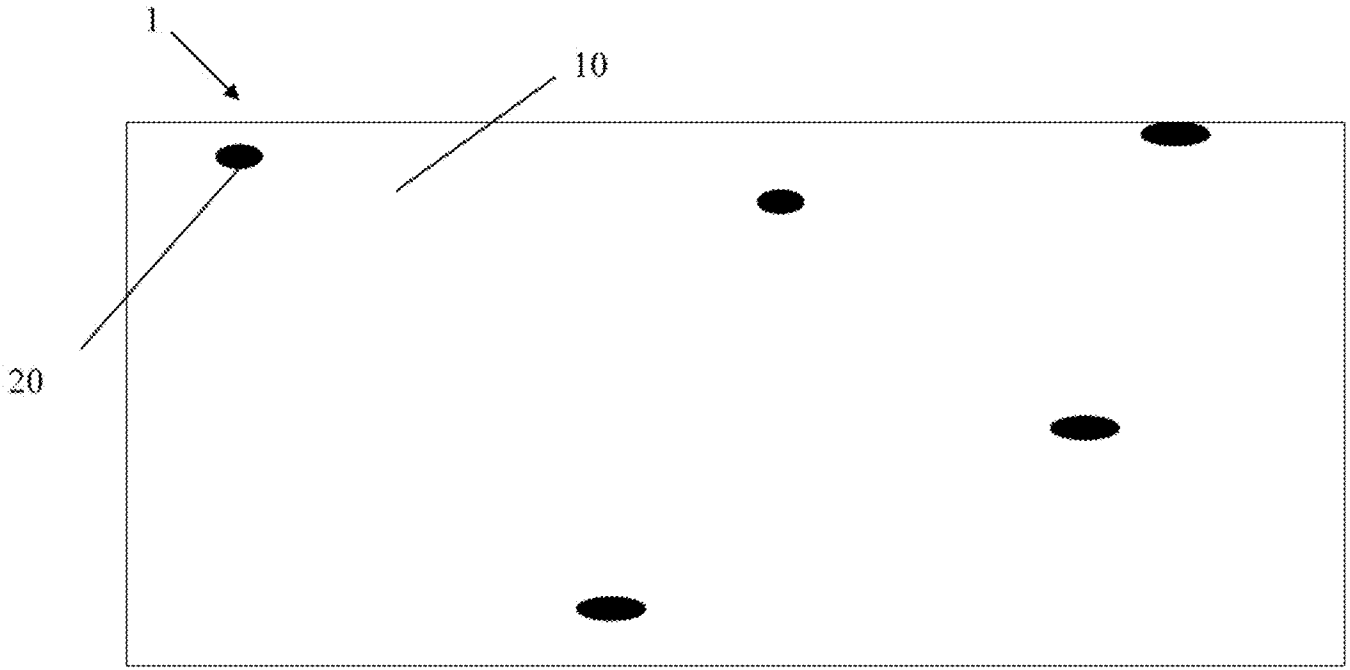
FIG. 1 is a schematic drawing illustrating a modified lubricant provided with nano-graphite plates according to the present invention.

FIG. 1 is a schematic drawing illustrating a modified lubricant provided with nano-graphite plates according to the present invention. As shown in FIG. 1, the modified lubricant 1 according to the present invention includes lubricant grease 10, and a plurality of nano-graphite plates 20 dispersing thoroughly in the lubricant grease 10. The content of the nano-graphite plates 20 is 0.0001 wt % to 10 wt % in the lubricant 1. Each nano-graphite plate has a length or width between 1 and 100 μm, and a thickness T within 10 nm and 100 nm.

Furthermore, the modified lubricant 1 further includes a dispersing agent and/or a surface affinity agent to improve the dispersing effect and/or surface affinity. The chemical formula of dispersing agent has two ends, one of which includes at least one of a carbon chains and a phenyl group, and another of which includes at least one of a sulfonic acid group, a cholic acid group, and a carboxylic group. In the actuality experiments, the thermal conductive coefficient of the modified lubricant 1 is greater than 0.2 W/mK.

Figure 2:
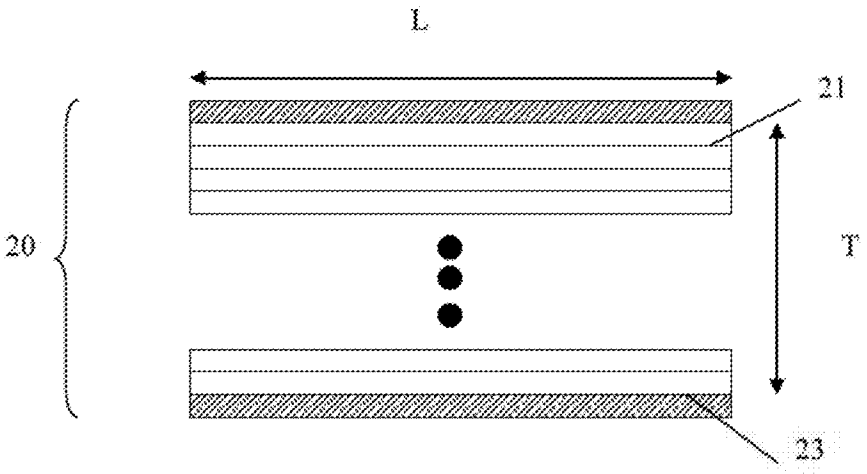
FIG. 2 is an enlarged side-view illustrating the nano-graphite plate shown in FIG. 1.

FIG. 2 is an enlarged side-view illustrating the nano-graphite plate 20 shown in FIG. 1. As shown in FIG. 2, the nano-graphite plate 20 includes N graphene layers 21 stacked together and at least one surface modifying layer 23 disposed on the top surface of the top graphene layer 21 and/or the bottom surface of the bottom graphene layer 21, wherein N is 30 to 300 and the ratio (L/T) of the lateral dimension L to the thickness T is within 10 and 10,000.

The surface modifying layer 23 at least includes one surface modifying agent, which includes at least two functional groups located at two ends of the surface modifying agent, respectively. One of the two functional groups is chemically bonded with certain organic functional group remaining on the surface of the nano-graphite plate 20, and the other of the two functional groups forms the functional surface of the nano-graphite plate 20. Thus, the surface characteristics of the nano-graphite plate 20 is changed, so that the nano-graphite plate structure is easily and evenly dispersed in the lubricant grease 10. The content of surface modifying agent in the nano-graphite plate 20 is within 0.02 and 20.0 wt %, and preferably 0.1 and 10.0 wt %.

The surface modifying agent includes at least one of coupling agent, fatty acid and resin. The coupling agent generally includes two parts, wherein one part is pro-inorganic group for adhering to some inorganic filler, and the other part is pro-organic group for adhering to organic resin. The coupling agent is generally silane, zirconate, aluminum zirconate, aluminate and chromate, and silane is the most common one. Moreover, the coupling agent is expressed by a chemical structure, $M_x(R)_y(R')_z$, where M is a metal element, R is a hydrophilic functional group, and R' is a hydrophobic functional group, $0 \le x \le 6$, $1 \le y \le 20$, and $1 \le z \le 20$. One end of R in the coupling agent is bonded with M, and the other end of R is hydrolyzed for the corresponding hydrophilic functional group, such that the surface of the nano-graphite plate 20 forms chemical bonding. One end of R' is bonded with M, and the other end of R' helps the surface of the nano-graphite plate 20 perform specific aspects different from natural graphite and pure graphene powder through the above various functional groups, such as easily dispersing in organic carrier, or reacting with organic molecules.

It is preferred that R is selected from the group consisting of alkoxyl, carbonyl, carboxyl, acyloxy, amide, alkyleneoxy and alkylene-carboxyl functional groups. M is selected from the group consisting of aluminum, titanium, zirconium and silicon. R' is selected from the group consisting of vinyl, fatty-alkyleneoxyl, styryl, methylacryloxyl, acryloxyl, fatty-amino, chloroproply, fatty-thiol, fatty-thioxo, isocyanato, fatty-phenolyl, fatty-carboxyl, fatty-hydroxyl, cyclohexyl, phenyl, fatty-formyl, fatty-acetyl and benzoyl functional groups.

The surface modifying agent is selected from fatty acid with higher carbon, which also has two functional groups at its two ends, respectively. One functional group reacts with the surface of nano-graphite plate 20, and the other functional group forms different surface aspects from nano-graphite plate 20. The fatty acid with higher carbon is selected from the group consisting of stearic acid and oleic acid. Additionally, the surface modifying agent is selected from resin with versatile functional groups so as to provide surface aspects different from that of the surface of nano-graphite plate 20. The resin is preferably selected from the group consisting of epoxy resin, polyurethane resin, silicone resin, phenolic resin and polyester resin.

Detailed description of the nano-graphite plate structure which is the intermediate product of the present invention is shown in the following embodiments.

Figure 3:
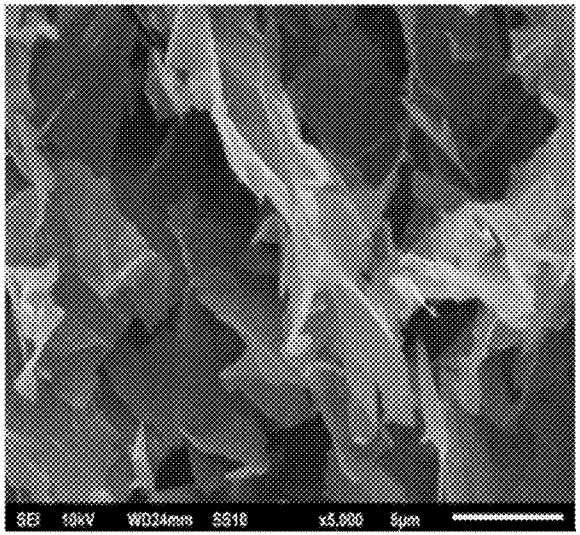
FIG. 3(*a*) is a SEM (Scanning Electron Microscope) view the nano-graphite plate structure which is the intermediate product of the present invention.
Figure 3:
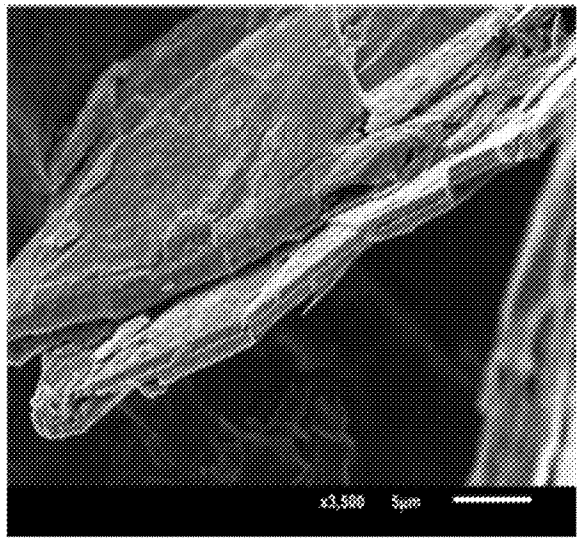
Figure 4:
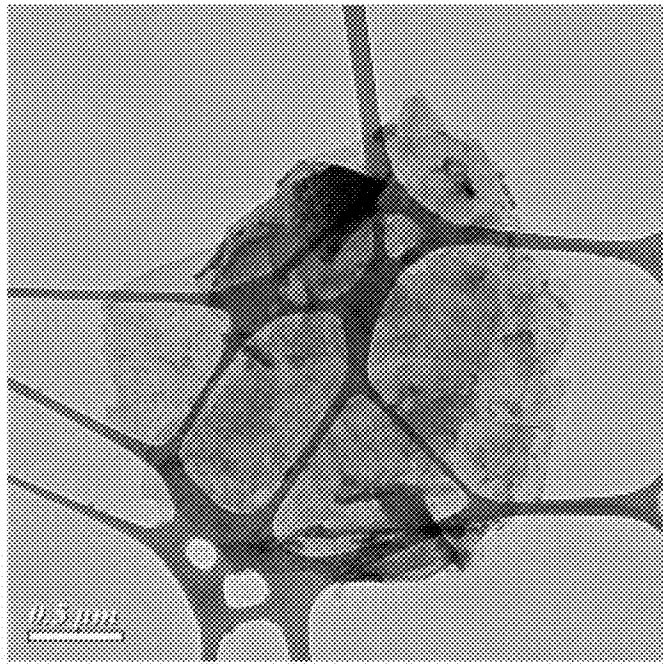
FIG. 4 is a TEM (Transmission Scanning Electron Microscope) view showing the nano-graphite plate structure which is the intermediate product of the present invention.
Figure 5:
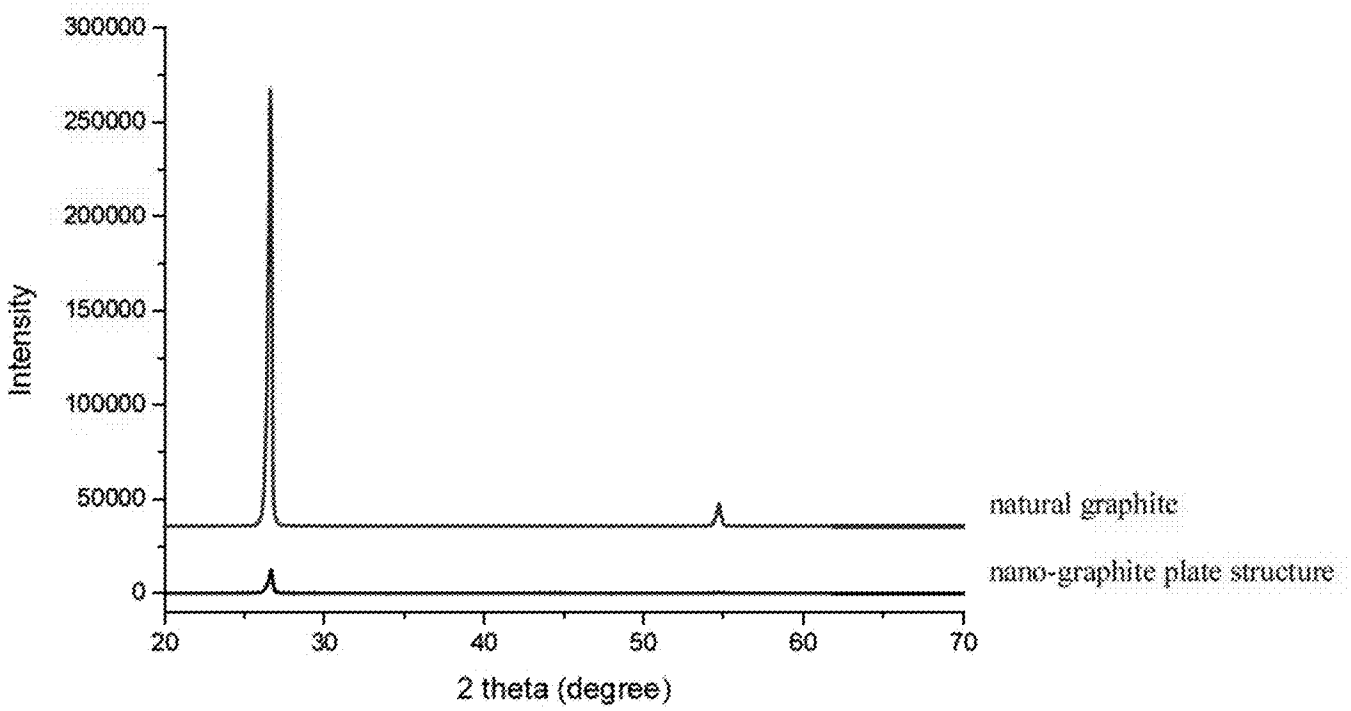
FIG. 5 shows the comparison result of the X-ray diffraction between the nano-graphite plate structure which is the intermediate product of the present invention and the natural graphite.

The nano-graphite plate structure is synthesized by the following steps. First, 5 g of natural graphite is prepared to mix with deionized water. The mixture is ground by a planetary ball mill with 1 mm zirconium oxide grinding balls for 6 hours and then ground with 0.1 mm zirconium oxide grinding balls for 12 hours. After the ground mixture is dried, the nano-graphite plate structure is formed, and has a tap density of 0.07 g/cm$^3$. FIG. 3(*a*) illustrates the SEM (Scanning Electron Microscope) view the nano-graphite plate of the present invention, and FIG. 3(*b*) illustrates the SEM view of natural graphite. There are apparent differences in thickness between the nano-graphite plate structure and natural graphite. The nano-graphite plate structure has a thickness of about 80 nm and a lateral dimension of about 10 μm. Thus, the ratio of the lateral dimension to the thickness is about 125. FIG. 4 shows a TEM (Transmission Electron Microscope) view of the nano-graphite plate structure. Clearly, the nano-graphite plate structure is a transparent sheet. With the nitrogen-oxygen analyzer, the oxygen content of the nano-graphite plate structure is about 2.5 wt %, and with the BET (Brunauer-Emmett-Teller) method, its specific surface area is about 23 m$^2$/g. FIG. 5 illustrates the comparison result of the X-ray diffraction of the nano-graphite plate structure and natural graphite. The characteristic peak of graphite is shown in FIG. 5. Specifically, the half-width of the peak of (002) lattice plane is 0.296, and that of natural graphite is 0.182. Therefore, the nano-graphite plate structure of the present invention has the structural property of nanometer material.

Additionally, the dodecyl benzene sulfonate which is used as the surface modifying agent is added into the nano-graphite plate structure as described above. The surface modifying layer 23 is formed on the surface of the nano-graphite plate structure after standing, such that the nano-graphite plate 20 of the present invention is formed.

Figure 6:
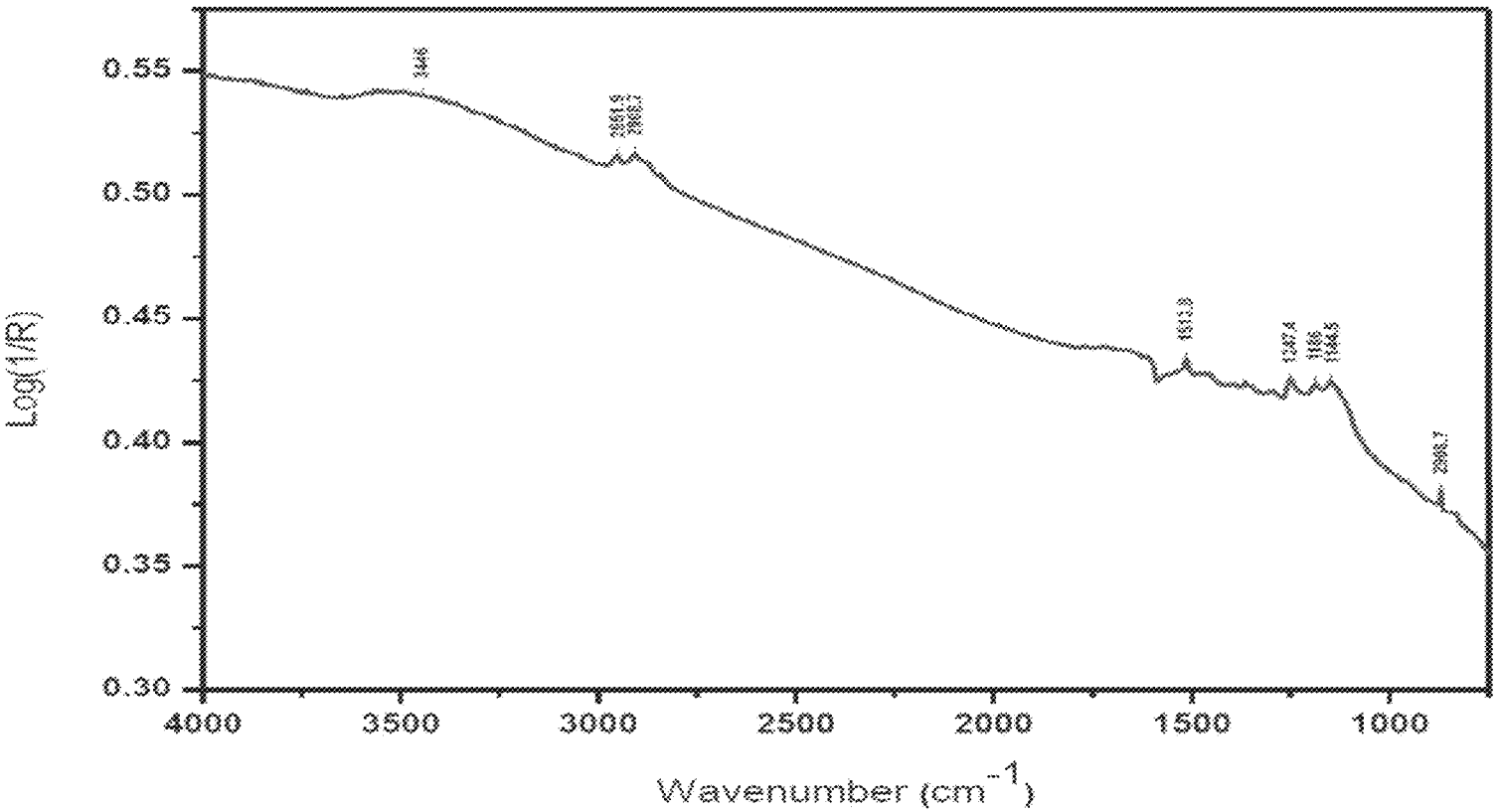
FIG. 6 is an infrared absorption graph of the nano-graphite plate of the present invention.

FIG. 6 shows the infrared absorption graph of the nano-graphite plate 20. The graph illustrates the absorption location of the long carbon chain, and thus it is proved that the surface of the nano-graphite plate 20 has a functional group of long carbon chain.

The modified lubricant 1 is formed by dispersing the nano-graphite plate 20 in the lubricant grease 10 thoroughly. Furthermore, a dispersing agent and/or a surface affinity agent can be further added.

Examples 1-5 are the real experimental examples of the modified lubricant 1 of the present invention. Examples 1-5 have different content of dispersing agent to evaluate the performance and effect of dispersing agent in the modified lubricant 1, wherein oleic acid is selected as the dispersing agent. The manufacturing method of the modified lubricant is that different amounts of nano-graphite plates 20 are added in the lubricant grease 10, then mixing and dispersing the nano-graphite plates 20 in the lubricant grease 10 thoroughly by mechanic or physical mixing, such as homogenizer, stirrer or supersonic vibrator. Then, the friction coefficient is measured by a four-ball tester. The measured results are shown in Table 1 to show the effect of the amount of the nano-graphite plates to the friction coefficient of the modified lubricant 1. It is easily known by the measured results of the friction coefficient, the lubricating property of the lubricant can be greatly improved by adding the nano-graphite plates of 0.0006 wt %. It is noted that the friction coefficient is raised by over-adding nano-graphite plates. The heat generated by friction and the temperature of a workpiece can be reduced and the lifetime of the workpiece can be extended by adding the nano-graphite plates in the lubricant. Therefore, adding the graphite plates can improve the performance of the lubricant, and the performance is obviously improved by adding only the nano-graphite plates less than 0.001 wt %, but not affect the manufacturing cost.

TABLE 1

| | nano-graphite plates (wt. %) | surface modifying agent (wt. %) | dispersing agent (wt. %) | lubricant grease (wt. %) | friction coefficient |
|---|---|---|---|---|---|
| Example 1 | 0 | 0 | 0 | 100 | 0.0538 |
| Example 2 | 0.0006 | 0.0003 | 0.0067 | balance | 0.0421 |
| Example 3 | 0.0019 | 0.0008 | 0.0202 | balance | 0.0499 |
| Example 4 | 0.0025 | 0.0010 | 0.0270 | balance | 0.0457 |
| Example 5 | 0.0050 | 0.0021 | 0.0540 | balance | 0.0815 |

The technical characteristics of the present invention is using the nano-graphite plate which has the properties between the natural graphite and graphene, and modifying the surface properties of the nano-graphite plates, therefore, the nano-graphite plates can be dispersed thoroughly in the lubricant grease and not aggregate due to Van der Waals' forces. Moreover, the thermal conductivity of the lubricant is improved due to the properties of the nano-graphite plates which are similar to the graphene.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A modified lubricant, comprising:

lubricant grease; and a plurality of nano-graphite plates dispersed thoroughly in the lubricant grease, wherein the content of the nano-graphite plates is 0.0001 wt % to 10 wt % in the lubricant grease, each nano-graphite plate has a length or a width between 1 and 100 μm, and a thickness within 10 nm and 100 nm, and each nano-graphite plate has N graphene layers stacked together and at least one surface modifying layer disposed on the top and/or bottom of the nano-graphite plates, wherein N is 30 to 300, the surface modifying layer has a surface modifying agent which includes at least two functional groups located at two ends of the surface modifying agent, one of the two functional groups is chemically bonded with certain organic functional group remaining on the surface of the nano-graphite plate, and the other of the two functional groups forms the functional surface of the nano-graphite plate, wherein the coupling agent has a chemical structure of $M_x(R)_y(R')_z$, M is a metal element, R is a hydrophilic functional group, and R' is a hydrophobic functional group, $0 \le x \le 6$, $1 \le y \le 20$, and $1 \le z \le 20$.

2. The modified lubricant as claimed in claim 1, wherein the surface modifying agent includes at least one of coupling agent, fatty acid and resin.

3. The modified lubricant as claimed in claim 2, wherein R is selected from a group consisting of alkoxyl, carbonyl, carboxyl, acyloxy, amide, alkyleneoxy and alkylene-carboxyl functional groups, M is selected from a group consisting of aluminum, titanium, zirconium and silicon, R' is selected from a group consisting of vinyl, fatty-alkyleneoxyl, styryl, methylacryloxyl, acryloxyl, fatty-amino, chloroproply, fatty-thiol, fatty-thioxo, isocyanato, fatty-phenolyl, fatty-carboxyl, fatty-hydroxyl, cyclohexyl, phenyl, fatty-formyl, fatty-acetyl and benzoyl functional groups.

4. The modified lubricant as claimed in claim 2, wherein the fatty acid is selected from a group consisting of stearic acid and oleic acid.

5. The modified lubricant as claimed in claim 2, wherein the resin is selected from a group consisting of epoxy resin, polyurethane resin, silicone resin, phenolic resin and polyester resin.

6. The modified lubricant as claimed in claim 1, wherein the surface modifying agent in the nano-graphite plate is within a range of 0.1 and 10.0 wt %.

7. The modified lubricant as claimed in claim 1, further comprising a dispersing agent and/or a surface affinity agent.

8. The modified lubricant as claimed in claim 7, wherein a chemical formula of the dispersing agent has two ends, one of which includes at least one of a carbon chains and a phenyl group, and another of which includes at least one of a sulfonic acid group, a cholic acid group, and a carboxylic group.

9. The modified lubricant as claimed in claim 1, wherein the thermal conductive coefficient of themodified lubricant is greater than 0.2 W/mK.

* * * * *